US010222147B2

(12) United States Patent
Krewulak et al.

(10) Patent No.: US 10,222,147 B2
(45) Date of Patent: Mar. 5, 2019

(54) FIRETUBE SCRAPER

(71) Applicant: CANADIAN NATURAL RESOURCES LIMITED, Calgary (CA)

(72) Inventors: Ken Krewulak, Slave Lake (CA); Stephen Scott, Calgary (CA); Kyle Fiolka, Calgary (CA); Michael Bucholtz, Calgary (CA)

(73) Assignee: CANADIAN NATURAL RESOURCES LIMITED, Calgary (CA)

( * ) Notice: Subject to any disclaimer, the term of this patent is extended or adjusted under 35 U.S.C. 154(b) by 57 days.

(21) Appl. No.: 15/216,204

(22) Filed: Jul. 21, 2016

(65) Prior Publication Data

US 2017/0023319 A1 Jan. 26, 2017

(30) Foreign Application Priority Data

Jul. 22, 2015 (CA) ..... 2897996

(51) Int. Cl.

| | |
|---|---|
| ***B08B 9/023*** | (2006.01) |
| ***F22B 37/48*** | (2006.01) |
| ***F28G 1/08*** | (2006.01) |
| ***F28G 15/02*** | (2006.01) |

(52) U.S. Cl.

CPC ..... *F28G 1/08* (2013.01); *F22B 37/486* (2013.01); *F28G 15/02* (2013.01)

(58) Field of Classification Search

CPC ..... B08B 9/0436; B08B 9/023; F41A 29/02; F22B 37/48; F28G 1/12

See application file for complete search history.

(56) References Cited

U.S. PATENT DOCUMENTS

| | | | | |
|---|---|---|---|---|
| 1,849,201 A | | 3/1932 | Niemann | |
| 2,782,436 A | * | 2/1957 | Tomer | B08B 9/023 15/104.04 |
| 2,813,285 A | * | 11/1957 | Aslin | B08B 9/023 15/104.04 |
| 5,630,368 A | * | 5/1997 | Wagoner | F22B 7/12 110/105 |
| 5,827,475 A | * | 10/1998 | Yamashiro | F27D 3/14 266/135 |
| 7,475,645 B2 | * | 1/2009 | Engvall | D21C 11/125 110/182.5 |

(Continued)

FOREIGN PATENT DOCUMENTS

| | | | | |
|---|---|---|---|---|
| FR | 2312739 A1 | * | 12/1976 | F24H 1/22 |
| GB | 190214336 A | | 12/1902 | |

(Continued)

*Primary Examiner* — Gregory A Wilson

(74) *Attorney, Agent, or Firm* — Berg Hill Greenleaf Ruscitti LLP

(57) ABSTRACT

A firetube scraper device comprising: at least one carriage assembly mounted on the firetube; a drive line and drive means for displacing the carriage assembly longitudinally along the firetube; wherein said carriage assembly surrounding the entire circumference of the firetube and comprising at least one row of scraper fins, each of said scraper fins having an inner surface adapted to frictionally engage an outer firetube surface defined by at least an upper portion of the surface of the firetube exposed to contaminants deposited onto a firetube surface.

19 Claims, 15 Drawing Sheets

(56) References Cited

U.S. PATENT DOCUMENTS

| | | | | |
|---|---|---|---|---|
| 7,765,960 | B2 | 8/2010 | Rozendaal | |
| 8,238,510 | B2 * | 8/2012 | Haberman | F22B 37/486 122/379 |
| 8,424,150 | B1 * | 4/2013 | Higgins | D21C 11/12 15/104.04 |
| 2016/0193632 | A1 * | 7/2016 | Vahida | B08B 1/005 15/93.1 |

FOREIGN PATENT DOCUMENTS

| | | | |
|---|---|---|---|
| GB | 191307764 | A | 12/1913 |
| JP | S6380195 | A | 4/1988 |
| JP | 2006138572 | A | 6/2006 |

* cited by examiner

FIRETUBE SCRAPER

CROSS-REFERENCE TO RELATED APPLICATIONS

This application claims the benefit of Canadian Patent Application No. 2,897,996, filed Jul. 22, 2015, the entire contents of which are incorporated herein by reference.

FIELD OF THE INVENTION

This invention is directed to cleaning systems used in industrial boilers, more specifically it is directed to a system for removal of contaminants on the external surface of firetubes on boilers.

BACKGROUND OF THE INVENTION

In the oil and gas industry, boilers are used to heat oil emulsion to aide in the removal of water and solids from the oil emulsion. Solids and contaminants from the emulsion collect on the firetube reducing the heat transfer through the tube and increasing the skin temperatures of the firetube, eventually causing material failure.

A firetube is used to heat up a vessel containing an oil and water emulsion and aide the separation of these two components. The initial emulsion may contain polymers, scales, asphalthenes or solids that can collect on the firetube outer surface. The skin temperatures on the firetube are quite high and some contaminants may cook onto the firetube in a hard layer. These cooked on contaminants cannot be removed from the firetube surface using conventional desanding methods. The presence of contaminant buildup causes a reduction of heat transfer from the firetube and can lead to the failure of the firetube through localized overheating. Frequent failures, in the range of every few months, lead to increase treatment costs and undesirable vessel shutdowns to replace damaged firetubes.

GB 190214336 entitled "Improvements in Mechanical Boiler Cleaners" discloses a boiler of the tubular type, and having tubes to clean as part of the object of the invention. Journaled in the ends of the boiler, is a screw-threaded shaft which may be provided at its end extending through, the head or end of the boiler, with a stuffing-box to prevent leakage of steam or water. In referring to FIG. 1, the description states that the outwardly projecting portion of the shaft 22, is preferably formed with a squared end 24, to fit in a similarly-shaped socket 25, on the inner end of a shaft 26, which is journaled in the door 27, of the smoke-chamber 28, of the boiler, and has mounted on its outer portion a pinion 29, to mesh with a gear 30, mounted on a crank-shaft 31, journaled on the door 27. The shaft 22, may be driven by hand, by means of the crank-shaft 31, and gears 29, and 30, or power may be applied by means of a belt (not shown), on a pulley.

GB 191307764 entitled "Improvements in or connected with Apparatus for Scraping Fuel Economisers for Heating Feed Water for Steam Boilers" discloses a class of fuel economisers (known as a horizontal economiser) for heating feed water for steam boilers and in which the tubes are arranged in sections resting on their edges or on the ends of their respective headers in such a way that the tubes have a slight inclination from the inlet to the outlet. The description states that the invention consists of an improved mechanism for actuating the scrapers in an efficient manner without fear of them sticking or tilting. The description states that a driving and reversing mechanism containing a belt driving pulley with spring clutch adjustable to slip in case of obstruction or excessive strain in the scraper gear is positioned at one end of the tubes. The frames carrying the scrapers are provided with wheels which run on or between, rails arranged parallel with the tubes so as to take the weight of the frames and scrapers off the tubes and ensure easy running.

U.S. Pat. No. 7,765,960 entitled "Device for cleaning the fire tubes in a boiler" discloses a device for use when cleaning the heating surface of a tube changer, such as the fire tubes in a boiler, having a scraper member that is fixed to a movement member for moving the scraper member through one fire tube at a time and a guide for positioning the scraper member directly in front of the open end of a fire tube, such that said scraper member can be moved from the guide into the fire tube and conversely from the fire tube into the guide. The description also states that the guide can be moved on a frame transversely with respect to the longitudinal direction of the fire tubes for automatic cleaning of the fire tubes both when in service and out of service.

U.S. Pat. No. 1,849,201 entitled "Pipe cleaning machine" discloses a pipe cleaning machine comprising a frame, means to secure the frame to a pipe so as to secure said pipe against rotation with respect thereto; a pair of feed screws at opposite sides of said frame and revolvable therein; means for revolving said feed screws; a carriage adapted to surround said pipe and to be moved longitudinally thereon by means of said feed screws; means for engaging and for releasing the operative connection between said feed screws and said carriage, and a plurality of scraping knives affixed to said carriage their edges being turned substantially at right angles to the longitudinal axis of the pipe and overlapped so that the entire pipe circumference is touched by knife edges.

U.S. Pat. No. 2,782,436 entitled "Pipe cleaner with tandem scraping heads" discloses an exterior scraper assembly which is adapted to contact with a pipe surface and enter the pitted areas therein to remove foreign matter therefrom. The description teaches an apparatus comprising a pair of cleaning heads connected in tandem by self-adjusting coupling means whereby the front and rear heads are individually free to follow the contour of the pipe when bends are encountered. Each head is provided with a plurality of concave rollers for peripherally aligning the head frames with the axis of the pipe. A plurality of spaced cutter knives are pivotally held on the forward ends of cantilever spring supports which are anchored to the head frames. The description states that the cutter knives carried by each of the heads are arranged in non-tracking or peripherally off-set arrangement so as to have complete coverage of the pipe surface. A secondary spring arm releasably retains the cutter knives at right angles to the axis of the pipe, but the knives are permitted to revolve radially on a hinge means at the end of the cantilever spring support.

U.S. Pat. No. 2,813,285 discloses an apparatus comprising a divided cylindrical head supporting a multiplicity of radially projecting cut with the pipe surface. The apparatus includes spring means for holding the cutter elements yieldingly against the surface of the pipe and for maintaining the cutter means at right angles with respect to the surface of the pipe line. The description states that the cutter unit comprises two rows of offset cutters and is pulled along the line by a truck winch or other drawing power. In tandem with the scraper is a brush-containing pipe cleaner which is attached to the scraping assembly by short lengths of chain. The brush assembly sweeps away any remaining coating or scale to provide a thoroughly cleaned pipe surface.

JP63080195A (Apr. 11, 1988) "Heat Transfer Tube Cleaning Device" discloses a heat transfer tube cleaning device which removes scale, dirt and stain attached to the external surfaces of heat transfer tubes in a heat exchanger by providing an outer frame which reciprocates parallel to a heat transfer tube with a divisional body on which a brush is planted that contacts and slides on the external surfaces of a heat transfer tube.

JP2006138572A (Jun. 1, 2006) entitled "Method for Cleaning Boiler Water Tube" teaches a method for cleaning boiler water tubes that can efficiently clean boiler water tubes without burdening an operator by enabling free movement in boiler water tube banks. It is said that the boiler water tubes are cleaned with a boiler water tube cleaning apparatus comprising a water tube bank traveling cleaning device mounted with rotary brushes and movable axially and vertically in a boiler water tube bank 1 to clean the boiler water tubes, and a tube row direction mobile device movable in a tube row direction as housing the water tube bank traveling cleaning device.

In light of the above prior art, there is still a need for a firetube cleaner adapted to effectively clean the outside of such which combines reliability, relative ease of mounting and allows for simple replacement of scraper fins without the dismantlement of the entire device.

SUMMARY OF THE INVENTION

According to one aspect of the present invention, there is provided a firetube scraper device comprising at least one carriage assembly mounted on the firetube;

a drive line and drive means for displacing the carriage assembly longitudinally along the firetube;

wherein said carriage assembly surrounding the entire circumference of the firetube and comprising at least one row of scraper fins, each of said scraper fins having an inner surface adapted to frictionally engage an outer firetube surface defined by at least an upper portion of the surface of the firetube exposed to contaminants deposited by gravity.

Preferably, scraper fins are arranged so as to remove contaminants such as sand and other contaminants (polymer residues, scale, etc.) off of the entire firetube surfaces on which they will deposit. More preferably, the scraper fins are arranged so as to cover at minimum the uppermost quadrant surface of the firetube, which is where contaminants may collect more readily. By that, it is meant an area of the firetube which extends roughly 45 degrees on one side and 45 degrees on the other side of an axis running along the length of the firetube and defined by the uppermost point on the surface of the firetube.

According another aspect of the present invention, there is provided a firetube scraper device comprising adapted to be mounted on a horizontal section of a firetube:

at least one carriage assembly;

a drive line and drive means for displacing the carriage assembly longitudinally along the firetube;

a desanding line located substantially above and parallel to the drive line, said desanding line comprising a spraying system adapted to spray a liquid onto the carriage assembly;

wherein said carriage comprising a plurality of rows of scraper fins arranged around the circumference of the carriage assembly so as to frictionally contact an external surface of the firetube.

Preferably, the spraying system comprising a plurality of nozzles positioned on an arm extending laterally from the desanding line.

According to a preferred embodiment of the present invention, the carriage assembly further comprises two opposite ends flexibly connected to one another to surround the circumference of the firetube.

According to a preferred embodiment of the present invention, the scrapers from at least two of the plurality of rows of scraper fins are staggered relative to one another. Preferably, each one of the plurality of the rows of scraper fins substantially surrounds the circumference of the firetube.

According to a preferred embodiment of the present invention, each scraper fin has a front side and a backside, the front side having a curvature adapted to frictionally contact the external surface of the firetube. Preferably, each one of the scraper fins has a curved front surface adapted to frictionally engage the curvature of the firetube. Also preferably, backside of a scraper fin comprises a plurality of projections substantially perpendicular to the backside. More preferably, backside comprising fastening means positioned on the projections for securing the scraper fin to the carriage assembly.

According to another preferred embodiment of the present invention, the backside comprises at least one lateral aperture located on a projection, said aperture adapted to receive a scraper fastening means. Preferably, the scraper fastening means is a rod adapted to be inserted through an aperture located on the clamp arm and through the aperture located in the projection of the scraper fin.

According to a preferred embodiment of the present invention, the carriage assembly comprises:

a main overhead carriage member operationally connected to the drive line; and at least one pair of clamp arms, each clamp arm having two extremities;

wherein each one of said clamp arm having a first extremity flexibly connected to the main overhead carriage member and a second extremity connected to a second extremity of the opposite clamp arm by fastening means.

Preferably, each one of said clamp arms having an elongated arcuate shape adapted to contour the curvature of the firetube. Also preferably, the fastening means are selected from form the group consisting of: springs; nuts and bolts, clamps. More preferably, the fastening means is a spring adapted to resiliently secure the opposing second extremities of the at least two clamp arms to provide frictional contact of the scrapers onto the firetube.

According to a preferred embodiment of the present invention, the carriage assembly comprises two pairs of clamp arms, each pair spaced apart from one another by at least one row of scraper fins.

According to another preferred embodiment of the present invention, each clamp arm has a plurality of spaced apertures located along a side thereof and adapted to receive there through a scraper fin fastening means. Preferably, the scraper fin fastening means is a rod.

BRIEF DESCRIPTION OF THE FIGURES

The invention may be more completely understood in consideration of the following description of various embodiments of the invention in connection with the accompanying figure, in which.

DETAILED DESCRIPTION OF A PREFERRED EMBODIMENT OF THE INVENTION

Figure 1:
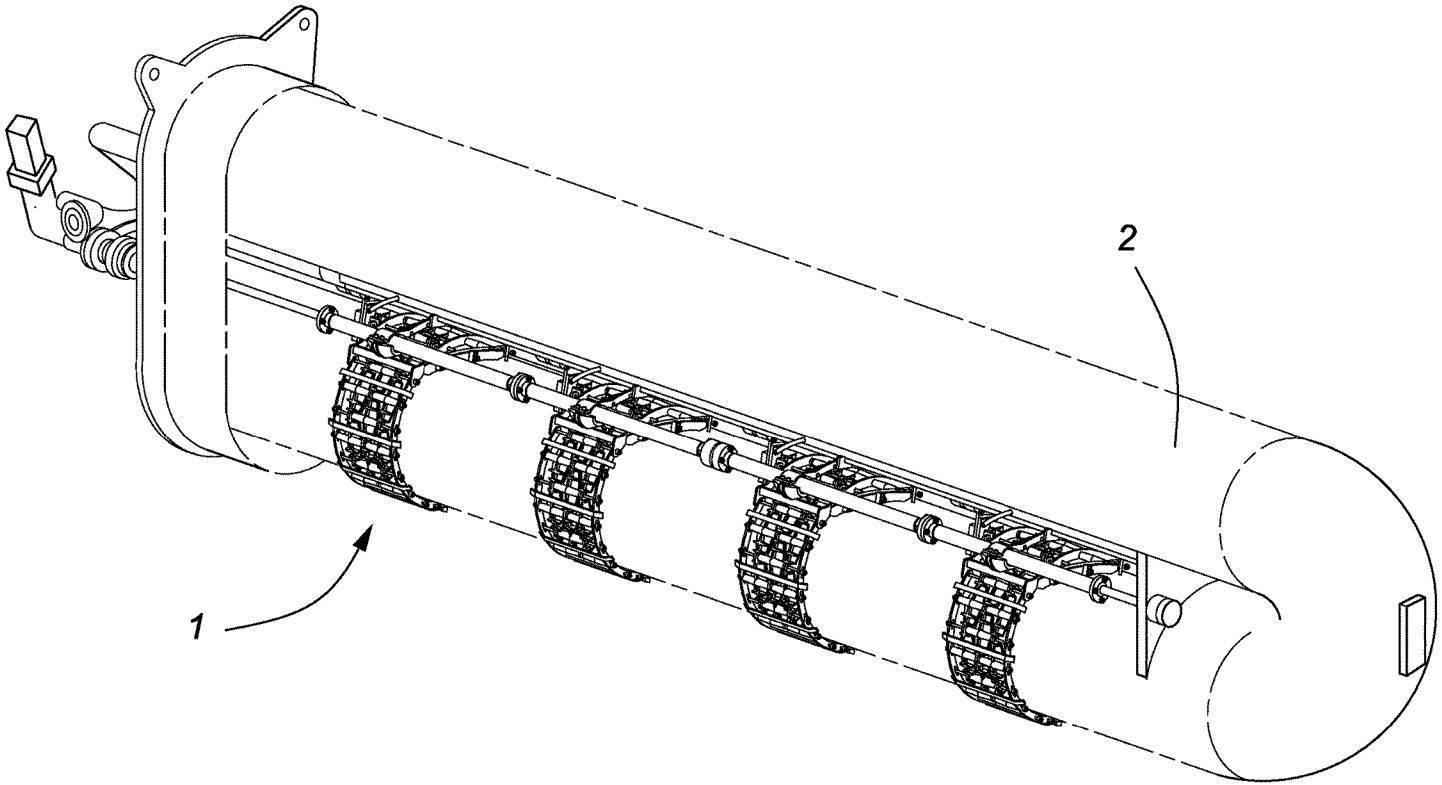
FIG. 1 is a perspective view of the firetube scraper device according to a preferred embodiment of the present invention.
Figure 2:
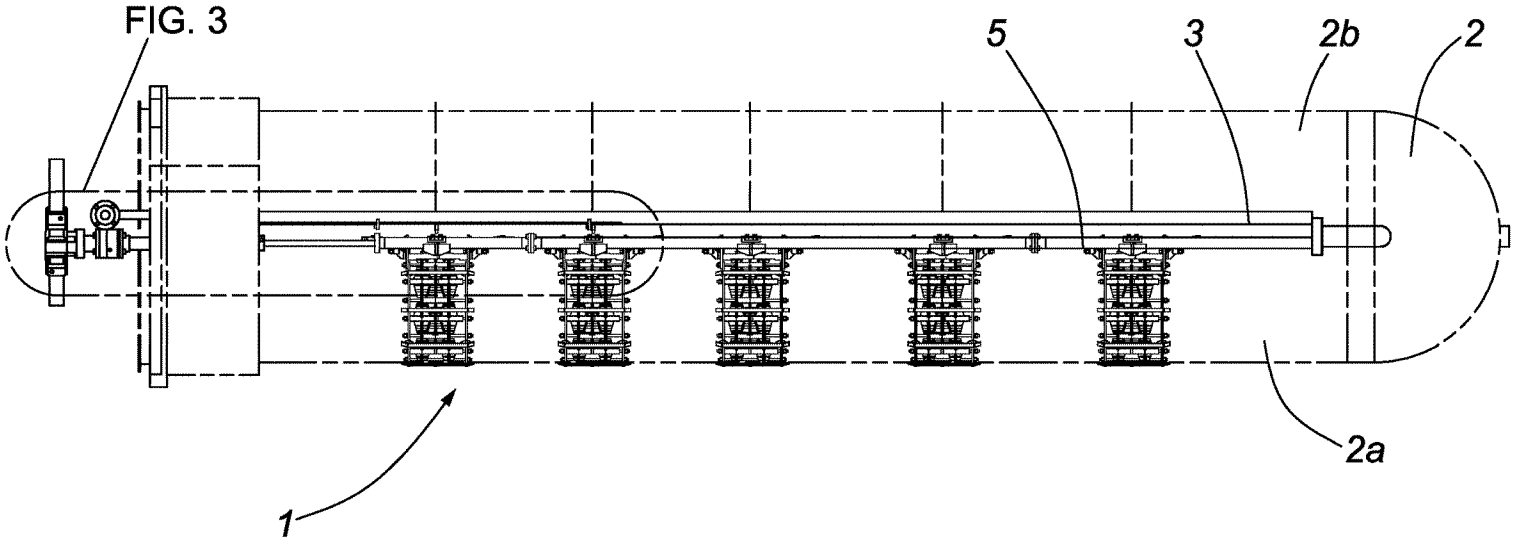
FIG. 2 is a side view of the firetube scraper device according to a preferred embodiment of the present invention.

FIGS. 1 and 2 show the firetube scraper device (1) according to a preferred embodiment of the present invention. The firetube scraper is intended to be used on the external surface of the tube (2) where polymers and other solids deposits under exposure to the high heat of the firetube. The deposition of the solids on the firetube leads to both a loss of effectiveness and eventual tube failure which is both costly and time intensive to replace. According to the preferred embodiment depicted in FIGS. 1 and 2, a desanding line (3) is located substantially above and parallel to the drive line (5).

According to the preferred embodiment illustrated in FIGS. 1 and 2, the firetube scraper is designed to be fitted around a firetube and to move longitudinally along the tube through the use of a screw drive mechanism. The screw drive is the preferred embodiment of the drive system, other drive mechanisms, such as hydraulic or pulley could function as another embodiment of the drive mechanism. A plurality of scraping tools affixed on the scraper around the circumference of the tube are in frictional contact with the surface of the tube and move along the surface thereof through the action of a screw drive mechanism. FIG. 1 shows a firetube and the scraper located at five different positions on the tube. FIG. 2 is a close up of the scraper showing the frame holding a plurality of scrapers (shoes) located in such a manner as to cover the entire circumference of the firetube.

Figure 14:
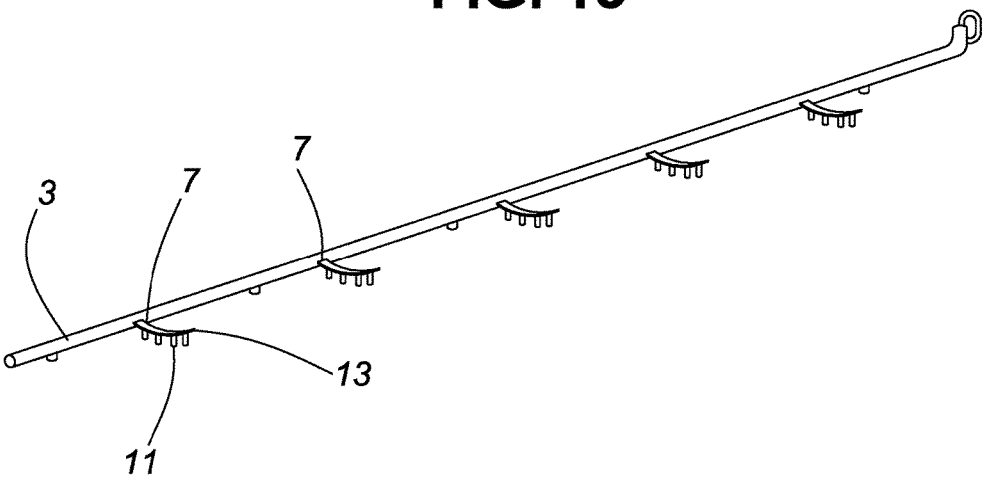
FIG. 14 is a perspective view of the desanding line used with the firetube scraper according to a preferred embodiment of the present invention.
Figure 15:
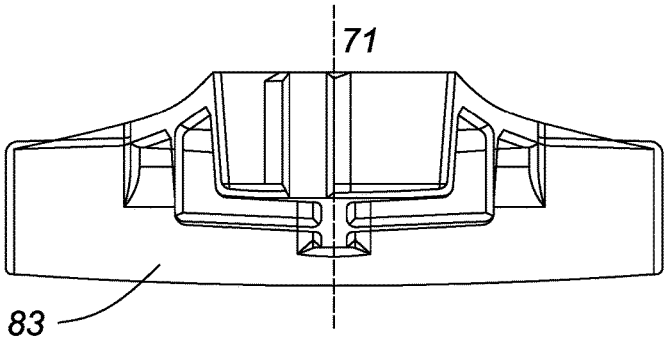
FIG. 15 is a front view of a scraper fin according to a preferred embodiment of the present invention.
Figure 16:
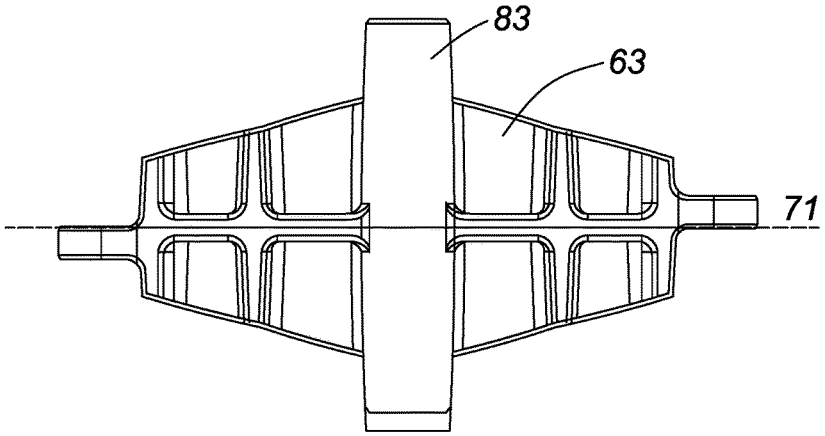
FIG. 16 is a back view of a scraper fin according to a preferred embodiment of the present invention.
Figure 17:
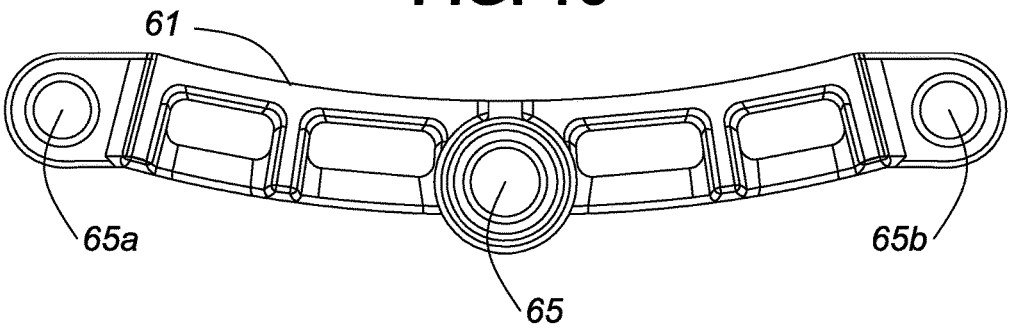
FIG. 17 is a side view of a scraper fin according to a preferred embodiment of the present invention.
Figure 18:
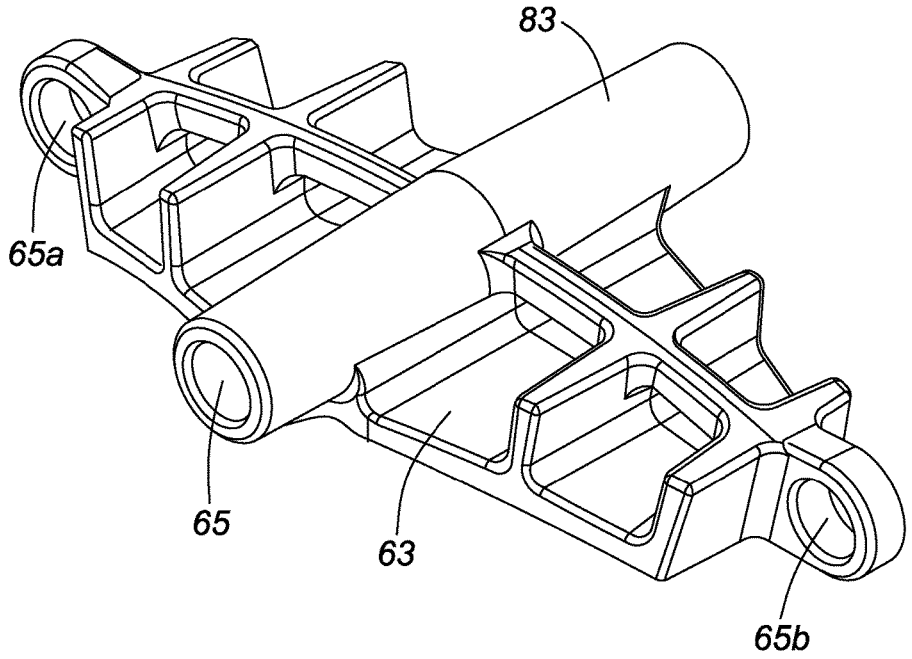
FIG. 18 is a perspective view of a scraper fin according to a preferred embodiment of the present invention.

As shown in FIG. 14, the desanding line (3) comprises a spraying system (7) adapted to spray a liquid onto the carriage assembly (9). The liquid is sprayed through a plurality of nozzles (11) positioned along a branch (13) substantially perpendicular to the desanding line (3). Preferably, the branch (13) has a slight outward curvature in order to have the liquid spray over a larger area of the carriage assembly (9). The liquid is discharged through the nozzles (11) at a velocity sufficient to reach the carriage assembly (9) and remove the particulates that have been removed by the scrapper fins (43). This has several advantages. First, it increases the life expectancy of the scraper fins as these wear out when rubbing the solid particulates contained in the liquid against the firetube. Prompt removal of these particulates through the use of the desanding line allows to minimize the time of contact between the scraper fins, the sand and the firetube. A second advantage is to make the scraping action more efficient as buildup is avoided or at least minimized thus facilitating the work of the scraper fins.

Figure 19:
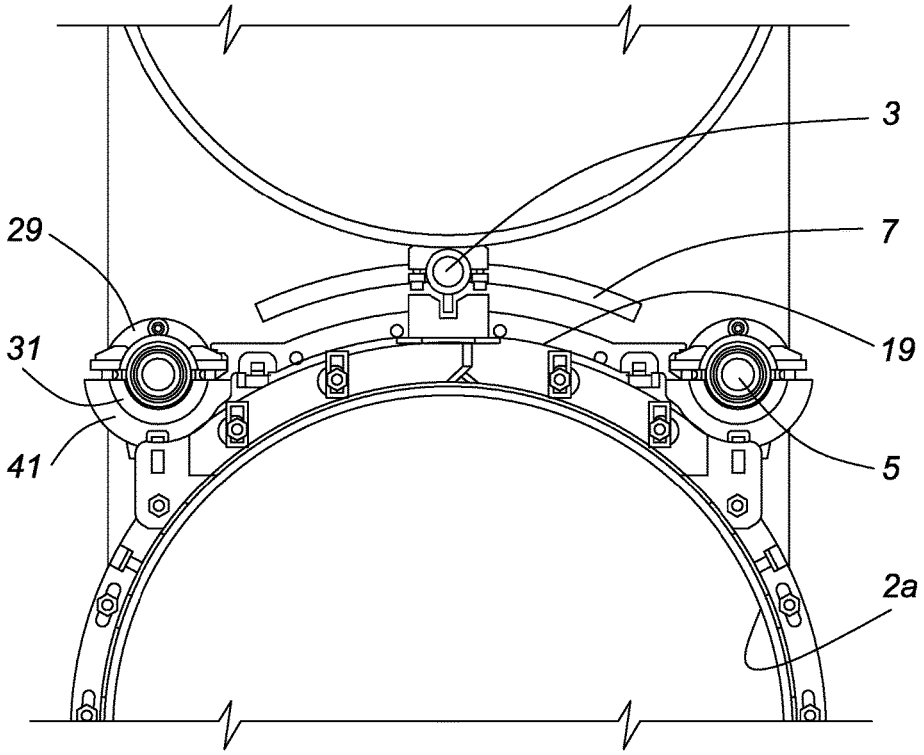
FIG. 19 is a cropped cross-sectional view of the firetube showing the carriage member according to a preferred embodiment of the present invention.
Figure 20:
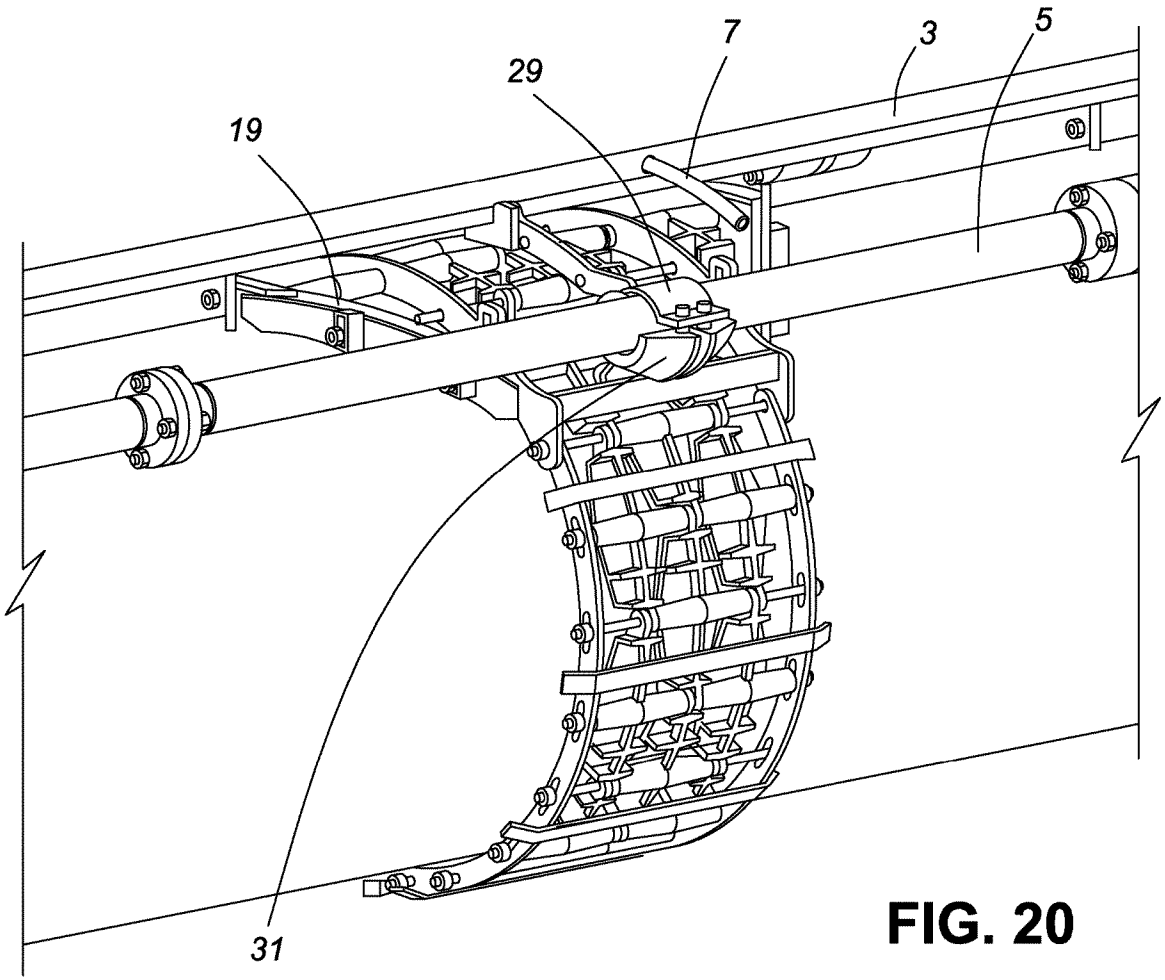
FIG. 20 is a close up perspective view of the firetube showing the carriage member according to a preferred embodiment of the present invention.

FIGS. 19 and 20 show an alternative embodiment of the desanding line where it is centrally mounted between the top section and the bottom section of the firetube. In this embodiment, the arms of the spraying system (7) of the desanding line (3) adopt the curvature of the bottom section of the firetube.

Drive Line

Figure 3:
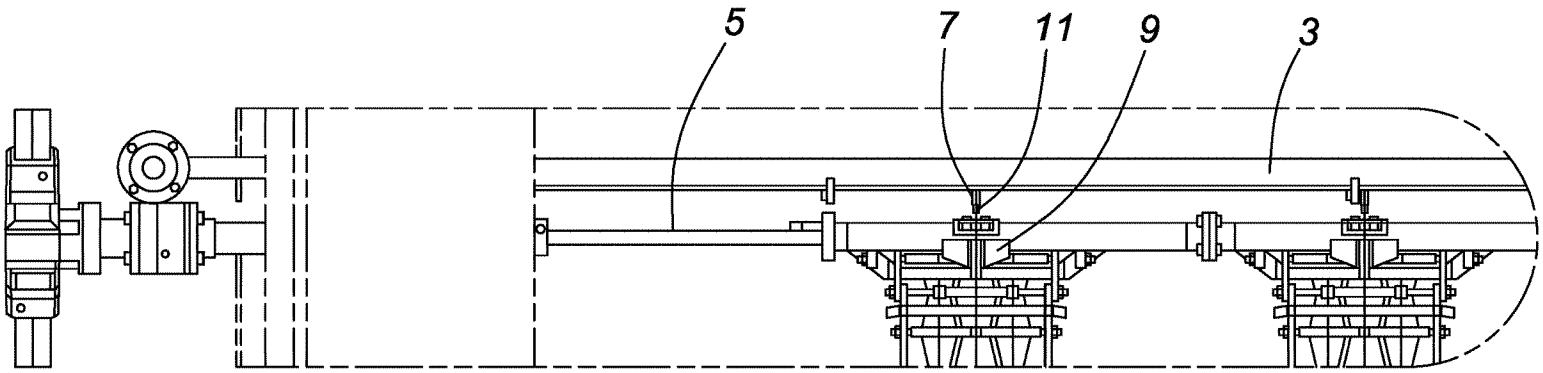
FIG. 3 is a cropped side view of the firetube scraper device according to a preferred embodiment of the present invention.
Figure 13:
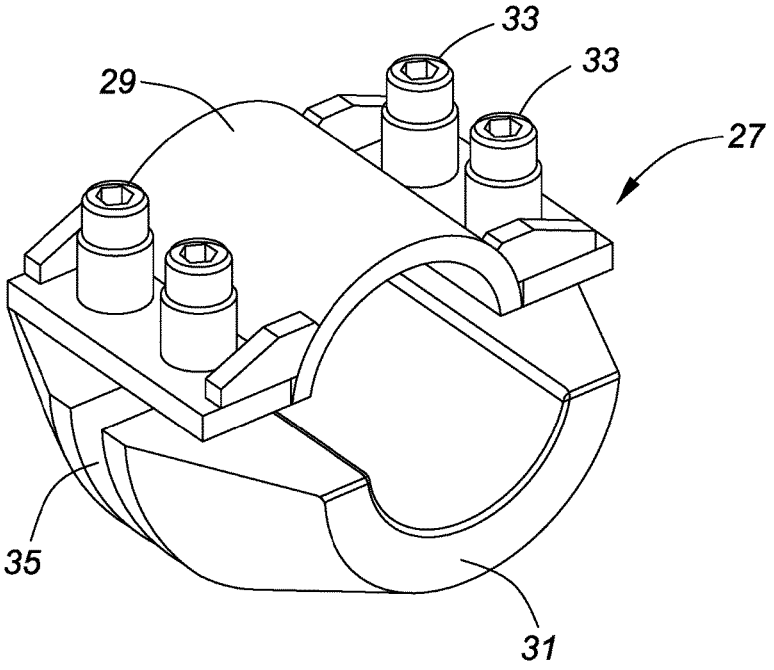
FIG. 13 is a perspective view of the mounting brackets for the carriage assembly according to a preferred embodiment of the present invention.

The embodiments shown in FIGS. 1 to 3 show a firetube scraper having 5 carriage assemblies (9) disposed along the length of the bottom tubing (2*a*). Each carriage assembly (9) is adapted to move longitudinally along the firetube and scrape a predetermined section thereof. The carriage assemblies are attached to the drive line (5) through supports (7) located on the main overhead carriage member (19). The drive line is itself installed on the firetube by installing a support member wedged in between the bottom (2*a*) and top (2*b*) tube sections. The drive line (5) comprises a gearbox mount which itself comprises the screw assembly to move the moving frame (25) along the drive line (5). The moving frame (25) comprises the mounting brackets (27) to mount each carriage assembly onto the drive line (5). The mounting brackets can be more clearly seen in FIG. 13. The mounting brackets comprise an upper section (29) and a lower section (31) bolted together through the use of four hexagonal screws (33). The lower section of the mounting brackets comprises a channel (35) in which the mounting support (41) is inserted during assembly and subsequently the lower and upper sections are fastened together with the screws (33). Preferably, each carriage assembly has at least one mounting bracket, more preferably they have two or more.

Figure 4:
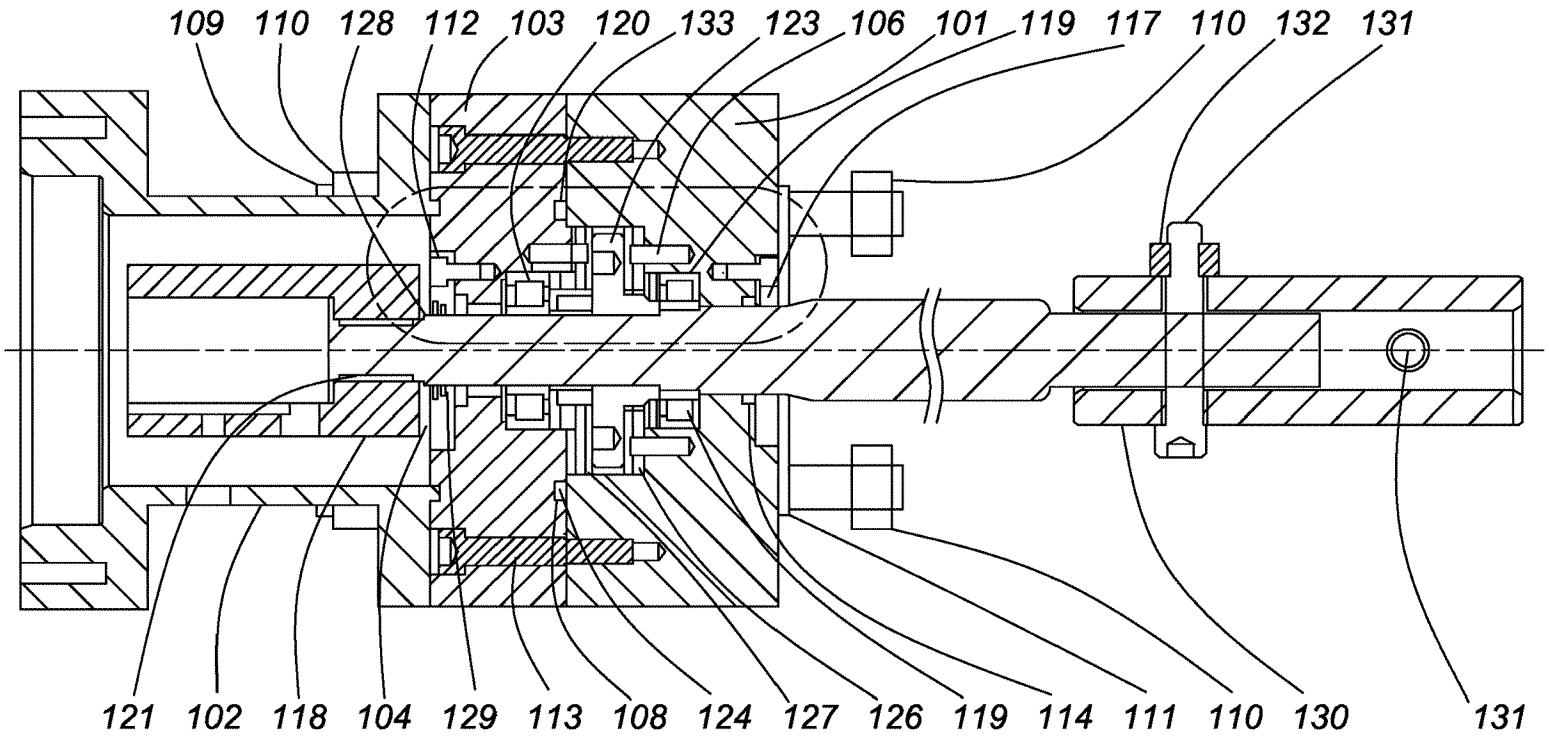
FIG. 4 is a close up side view of the drive rod assembly of the firetube scraper device according to a preferred embodiment of the present invention.
Figure 5:
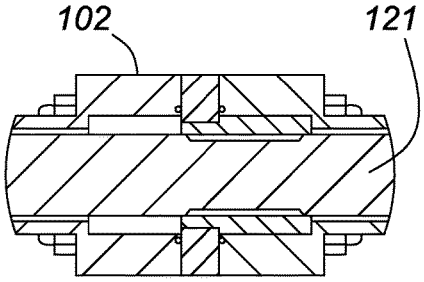
FIG. 5 is a close up side view of the beta drive system of the firetube scraper device according to a preferred embodiment of the present invention.
Figure 6:
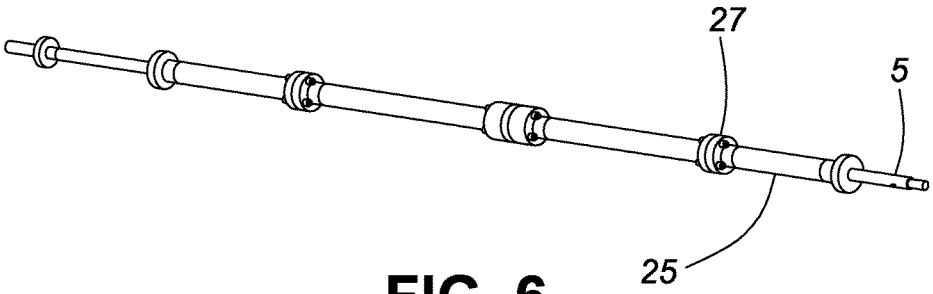
FIG. 6 is a perspective view of the beta drive system of the firetube scraper device according to a preferred embodiment of the present invention.
Figure 7:
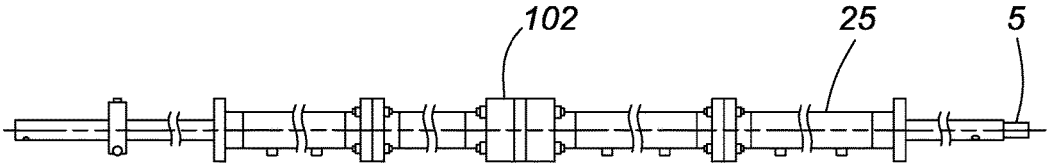
FIG. 7 is a side view of the beta drive system of the firetube scraper device according to a preferred embodiment of the present invention.

FIGS. 4 through 7 depict the drive line (5) and the various components making up the inner workings thereof. More specifically, FIG. 4 depicts the internals of the drive system. Present on the moving frame (25) of the drive line (5) is a series of various types of seals intended on eliminating the potential for leaks into the drive line. The relative simplicity of the movement (simply longitudinal) of the drive line is intended on minimizing the possible breakdowns of the moving parts of this device.

FIG. 4 shows a close up of the drive rod assembly. The thrust flange (101) is secured to the thrust flange cap (103) with socket head cap screws (113). The gearbox mount is fastened to the thrust flange (101), thrust flange cap (103) and vessel nozzle with stud bolts (109) and hex nuts (110). A dowel pin (106) secures the thrust washers (127) and washer spacers (126) inside the thrust flange (101) and thrust flange cap (103). An O-ring (108) seals the thrust flange (101) and the flange cap (103). Gasket (111) seals the thrust flange (101) to the vessel nozzle on the opposite side of the gearbox mount. Socket head cap screws (112) secure together a wiper seal, shaft seal, O-ring (129), and seal retainer ring (122) providing a seal between the thrust flange cap (103) and quill shaft (121). A speedi sleeve is installed on quill shaft (121) and is a replaceable sealing surface that wears as quill shaft (121) rotates relative to shaft seal and wiper seal. Shaft seal is the primary seal for the assembly. Seal gland (117) secures the primary seal (114) and primary wiper (107) to the thrust flange by means of socket head cap screws (112). Primary seal (114) and primary wiper (107) seal the quill shaft (121) to the thrust flange (101). A speedi sleeve is installed on quill shaft (121) and is a replaceable sealing surface that wears as the quill shaft (121) rotates relative to the primary shaft seal and primary wiper seal. An adapter (118) is located at the end of the shaft quill (121) and surround the latter's end. Adapter (118) converts the splined end connection of the quill shaft (121) to a suitable bore for connecting to the prime mover and/or gearbox (102). The quill shaft (121) is in rotational contact with bearings (119) and (120). All radial loads on quill shaft (121) are resolved through bearings (119) and (120). The thrust nut (123) and bearing nut (124) work in combination to resolve the thrust loads from the system. The bearing nut (124) is locked in place with set screws (133). The thrust nut (123) is in rotational contact with the thrust washers (127). Another spacer washer (126) is abutted against one side of the thrust nut (123) of the beta drive while a thrust washer (127) is abutted against the other side.

The coupling mechanism of the beta drive system includes a drive coupling (130), an hexagonal bolt (131) and nut (132).

FIG. 3 is a close-up view of the carriage assembly (9) and the spraying system (7) located above each carriage assembly (9) and adapted to spray the carriage as the latter moves back and forth during operation to clean the scraper fins.

Figure 8:
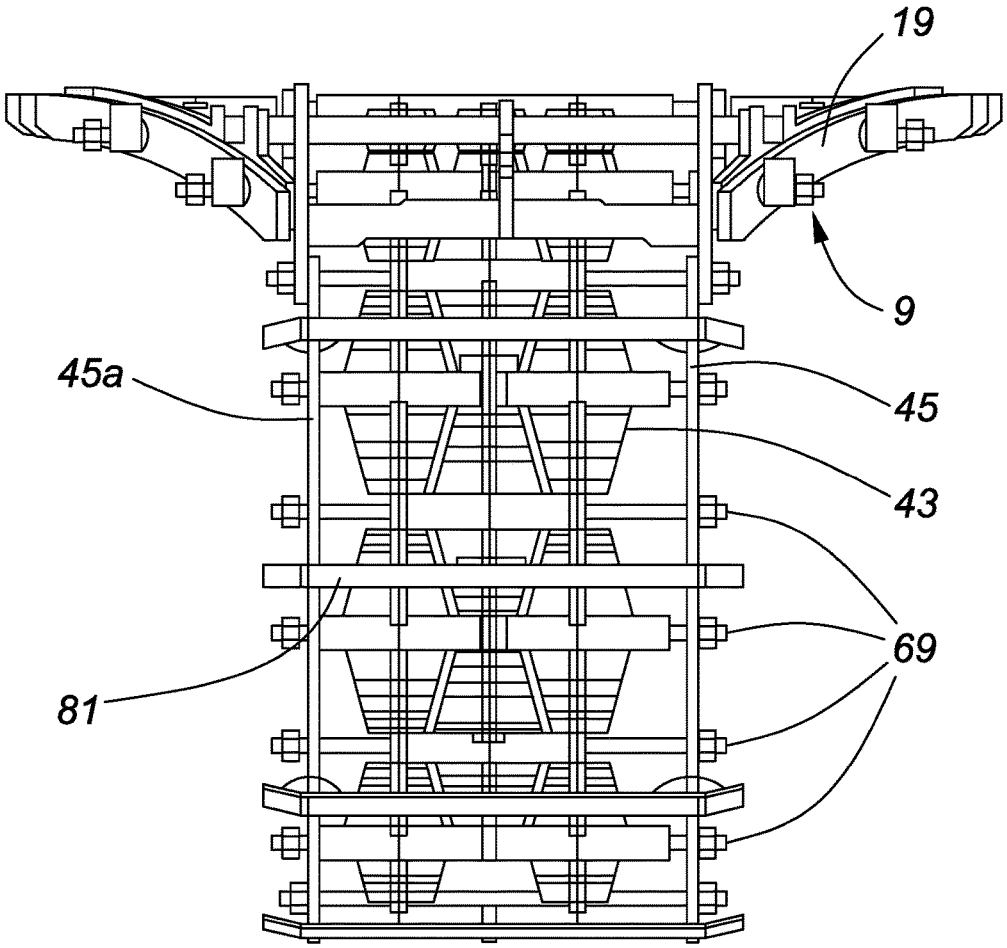
FIG. 8 is a side view of the carriage assembly of the firetube scraper device according to a preferred embodiment of the present invention.
Figure 9:
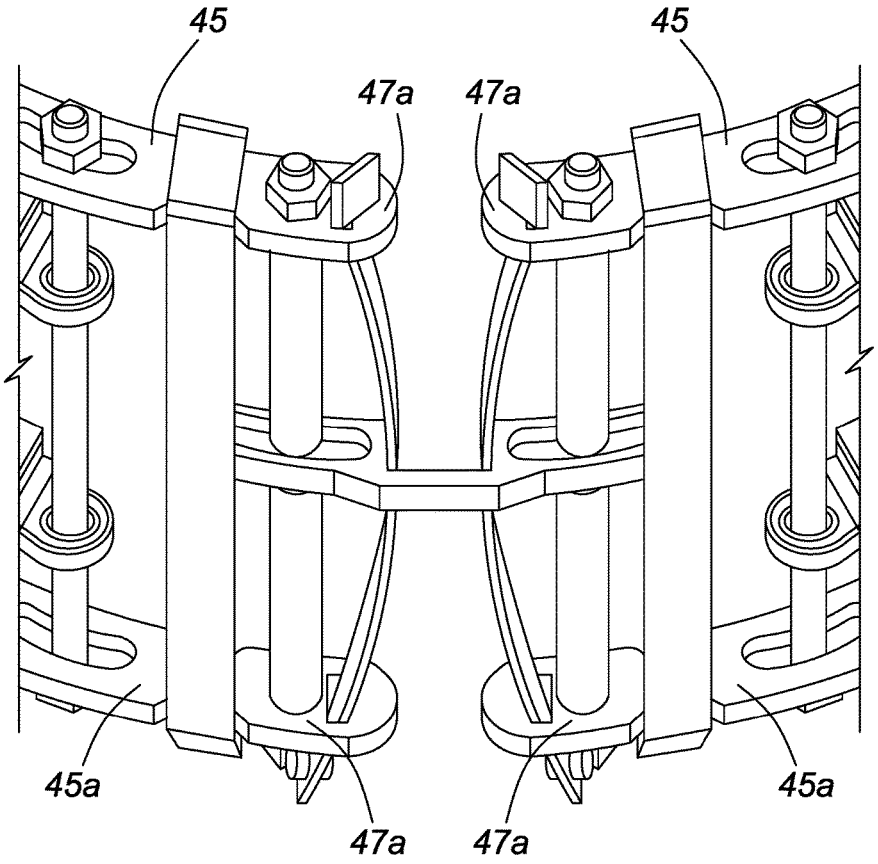
FIG. 9 is a close up perspective view of the spring retainer of the carriage assembly of the firetube scraper device according to a preferred embodiment of the present invention.
Figure 10:
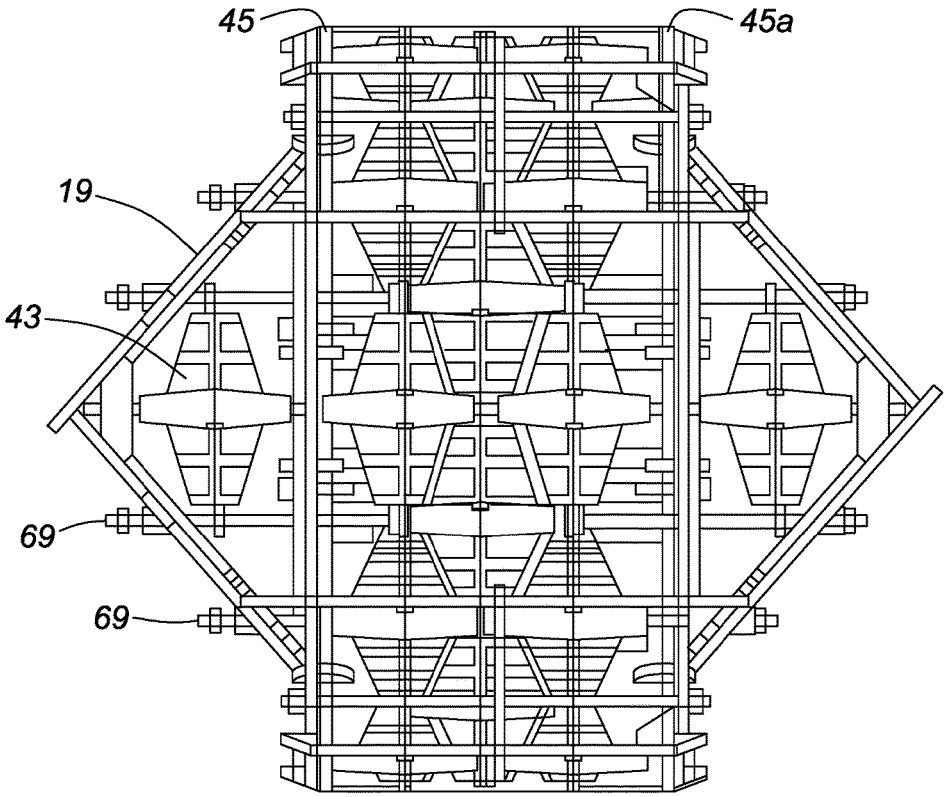
FIG. 10 is a top view of the carriage assembly of the firetube scraper device according to a preferred embodiment of the present invention.
Figure 11:
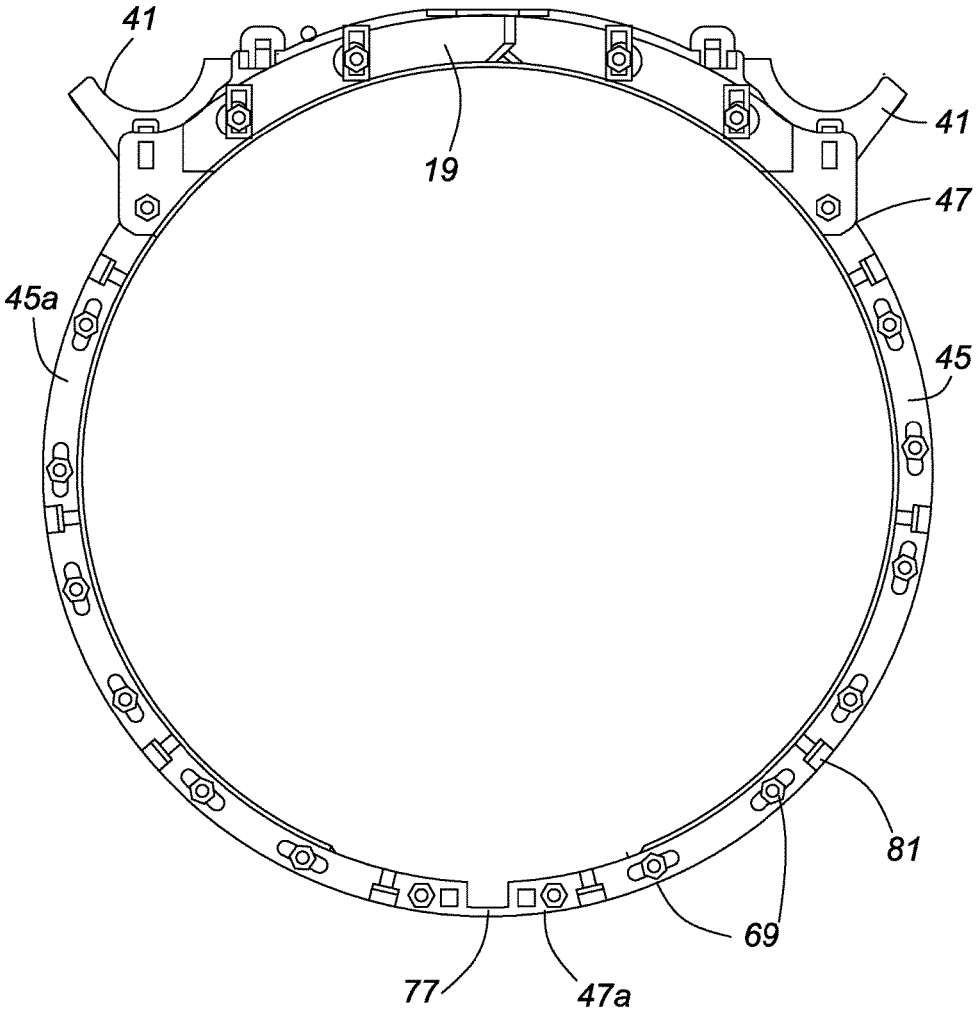
FIG. 11 is a front view of the carriage assembly of the firetube scraper device according to a preferred embodiment of the present invention.
Figure 12:
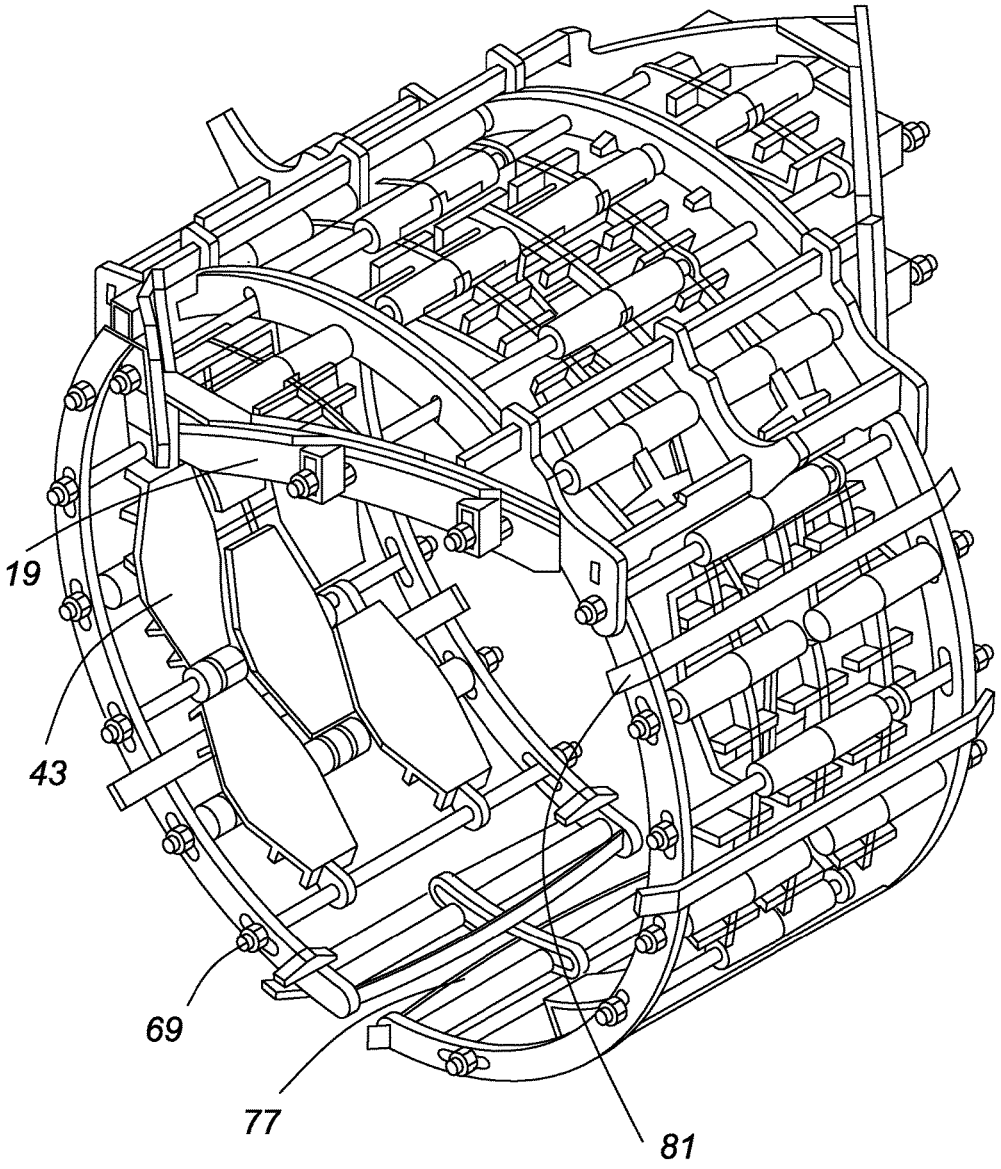
FIG. 12 is an elevated perspective view of the carriage assembly of the firetube scraper device according to a preferred embodiment of the present invention.

FIGS. 8-12 show the carriage assembly of the firetube scraper device according to the embodiment of FIGS. 1-3. FIGS. 8 and 11 show the placement of the scraper fins to show the staggering of scraper fins (43) on each subsequent row of fins to ensure proper scraping of the external surface of the firetube (2).

Carriage Assembly

According to a preferred embodiment of the present invention as depicted in FIGS. 8 to 12, the carriage assembly comprises: a main overhead carriage member (19) operationally connected to the drive line (5) through support (41); and two pairs of clamp arms (45) and (45*a*), each clamp arm (45) having two extremities (47) and (47*a*); wherein each one of said clamp arm having a first extremity (47) hingedly connected to the main overhead carriage member (19) and a second extremity (47*a*) connected to a second extremity of the opposite clamp arm by fastening means. Preferably, the main overhead carriage member (19) is a weldment. A weldment is a unit composed of an assemblage of pieces welded together. The mounting supports (41) adapted to be mounted on the mounting brackets (27) located on the moving frame 25 of the drive line (5) are preferably mounted on the main overhead carriage member (19).

Scraper Fins

FIGS. 15 to 18 illustrate the scraper fins according to a preferred embodiment of the present invention. Each scraper fin (43) has a front side (61) and a backside (63), the front side (61) having a curvature adapted to frictionally contact the external surface of the firetube. According to a preferred embodiment, the backside of a scraper fin comprises a plurality of projections substantially perpendicular to the backside. More preferably, the backside (63) comprising fastening means attachment points (65, 65*a*, 65*b*) positioned on the projections for securing the scraper fin (43) to the carriage assembly (9). Also more preferably, the backside comprising at least one lateral aperture located on a projection, said aperture adapted to receive a scraper fastening means (69).

According to the illustrated embodiment, the scraper fastening means is a rod (69) adapted to be inserted through an aperture located on the clamp arm and through the aperture located in the projection of the scraper fin.

Preferably, the rod will be inserted through an aperture located proximate the middle of the back side (63) of a scraper fin located on a first row and through an aperture located proximate one extremity of the backside of a scraper fin located on the subsequent row.

According to a more preferred embodiment, the rod (69) will be inserted through an aperture located in the middle of the backside of a scraper fin on a first row and the apertures located on the adjoining extremities of the backside of neighboring scraper fins located on the subsequent row. Ideally, the backside of the scraper has a total of at least three apertures adapted to receive rods therethrough to secure the scraper fins to the carriage assembly. The backside will define a longitudinal axis (71) preferably located in the middle thereof. Along this axis (71) are positioned a central aperture and an aperture located at a first extremity and an aperture located at the opposite extremity. Preferably, to allow more efficient placement of scraper fins (43) along a row, the apertures located at the first and second extremity are offset to one another with respect to the axis so as to allow staggering of the apertures from subsequent scraper fins and thus provide additional stability to each fin.

Preferably, each scraper fin has a central projection on its back side extending beyond the surface defined by the front side and adapted to abut on one end against the aperture located at one extremity of the backside of a scraper fin located on the subsequent row and at the opposite end against the clamp arm. Preferably also, the projections located at each extremity of the scraper fins also extend beyond the plane defined by the front surface so as to allow for a hinge connection with the extremity of the adjoining scraper fin.

Each rod (69) adapted to be inserted into the lateral apertures located on the projections (75) on the backside of the scraper fins (43) and fastened at both extremities (71*a*) (71*b*) to a clamp arm (45).

The pair of clamp arms (45 and 45*a*) are fastened to one another at their second extremity (47*a*) so as to surround the circumference of the firetube (2) further comprising a spring retainer (77) to maintain the clamp arms (45 and 45*a*) in proximate position around the firetube allowing frictional contact onto the external surface of the firetube by the scraper fins.

The embodiments described herein are to be understood to be exemplary and numerous modification and variations of the present invention are possible in light of the above teachings. It is therefore to be understood that within the scope of the claims appended hereto, the invention may be practiced otherwise than as specifically disclosed herein.

The invention claimed is:

1. A firetube scraper device comprising:

at least one carriage assembly mounted on the firetube;

a drive line and drive means for displacing the carriage assembly longitudinally along the firetube;

wherein said carriage assembly surrounding the entire circumference of the firetube and comprising at least one row of scraper fins, each of said scraper fins having an inner surface adapted to frictionally engage an outer firetube surface defined by at least an upper portion of the surface of the firetube exposed to contaminants deposited onto a firetube surface; and wherein each scraper fin has a front side and a backside, the front side having a curvature adapted to frictionally contact the external surface of the firetube, and wherein the backside of each scraper fin comprises a plurality of projections substantially perpendicular to the backside.

2. The firetube scraper device according to claim 1, further comprising a spraying system comprising a plurality of nozzles positioned on an arm extending laterally from a desanding line located substantially above and parallel to the drive line.

3. The firetube scraper device according to claim 2 wherein the carriage assembly further comprises two opposite ends flexibly connected to one another to surround the circumference of the firetube.

4. The firetube scraper device according to claim 1, wherein the at least one row of scraper fins includes at least two rows with scraper fins that are staggered relative to one another.

5. The firetube scraper device according to claim 1, wherein each one of the plurality of the rows of scraper fins substantially surround the circumference of the firetube.

6. The firetube scraper device according to claim 1, wherein each one of the scraper fins has a curved front surface adapted to frictionally engage the curvature of the firetube.

7. The firetube scraper device according to claim 1, wherein backside comprising fastening means positioned on the projections for securing the scraper fin to the carriage assembly.

8. The firetube scraper device according to claim 7, wherein backside comprising at least one lateral aperture located on a projection, said aperture adapted to receive a scraper fastening means.

9. The firetube scraper device according to claim 8, wherein the scraper fastening means is a rod adapted to be inserted through an aperture located on the clamp arm and through the aperture located in the projection of the scraper fin.

10. The firetube scraper device according to claim 1 wherein the carriage assembly comprises:

a main overhead carriage member operationally connected to the drive line; and at least one pair of clamp arms, each clamp arm having two extremities;

wherein each one of said clamp arm having a first extremity hingedly connected to the main overhead carriage member and a second extremity connected to a second extremity of the opposite clamp arm by fastening means.

11. The firetube scraper device according to claim 10, wherein each one of said clamp arms having an elongated arcuate shape adapted to contour the curvature of the firetube.

12. The firetube scraper device according to claim 11, wherein the fastening means is a spring adapted to resiliently secure the opposing second extremities of the at least two clamp arms to provide frictional contact of the scrapers onto the firetube.

13. The firetube scraper device according to claim 10, wherein the fastening means are selected form the group consisting of: springs; nuts and bolts, clamps.

14. The firetube scraper device according to claim 1, wherein the carriage assembly comprises two pairs of clamp arms, each pair spaced apart from one another by at least one row of scraper fins.

15. The firetube scraper device according to claim 14, wherein each clamp arm has a plurality of spaced apertures located along a side thereof and adapted to receive therethrough a scraper fin fastening means.

16. The firetube scraper device according to claim 15, wherein the said scraper fin fastening means is a rod.

17. The firetube scraper device according to claim 1, wherein the outer firetube surface defined by at least an upper portion of the surface of the firetube exposed to contaminants deposited onto the firetube surface is substantially the outer firetube surface defined as the uppermost quadrant of said firetube.

18. The firetube scraper device according to claim 1, wherein the outer firetube surface defined by at least an upper portion of the surface of the firetube exposed to contaminants deposited onto the firetube surface is substantially the outer firetube surface defined as the upper half of said firetube.

19. A firetube scraper device comprising at least one carriage assembly;

a drive line and drive means operatively connect to the carriage assembly and adapted to displace such longitudinally along the firetube;

a desanding line located substantially above and parallel to the drive line, said desanding line comprising a spraying system adapted to spray a liquid onto the carriage assembly;

wherein said carriage comprising a plurality of rows of scraper fins arranged around the circumference of the carriage assembly so as to frictionally contact an external surface of the firetube.

* * * * *